US005323564A

United States Patent [19]

Mensching et al.

[11] Patent Number: 5,323,564

[45] Date of Patent: Jun. 28, 1994

[54] PERFORMANCE STAGE DECK AND ASSEMBLY METHOD

[75] Inventors: William M. Mensching, New Canaan; Peter E. Mensching, New Fairfield, both of Conn.

[73] Assignee: Showtech, Inc., South Norwalk, Conn.

[21] Appl. No.: 956,721

[22] Filed: Oct. 2, 1992

[51] Int. Cl.[5] ..... E04H 3/26; E04H 6/06; E04B 2/82

[52] U.S. Cl. ..... 52/7; 52/29; 52/127.9; 52/582.2

[58] Field of Search ..... 52/7, 29, 36.1, 127.9, 52/585, 593

[56] References Cited

U.S. PATENT DOCUMENTS

| | | | |
|---|---|---|---|
| 1,259,352 | 3/1918 | Breen . | |
| 2,647,287 | 8/1953 | Jones | 52/127.9 |
| 3,181,203 | 5/1965 | Wenger | 52/7 X |
| 3,565,469 | 2/1971 | Zwart | 52/127.9 |
| 3,720,027 | 3/1973 | Christensen | 52/593 |
| 3,785,103 | 1/1974 | Turner | 52/127.9 X |
| 4,104,835 | 8/1978 | Bardwick | 52/7 |
| 4,507,010 | 3/1985 | Fujiya | 52/127.9 X |
| 4,512,122 | 4/1985 | Berkowitz | 52/127.9 |
| 4,638,604 | 1/1987 | Rogers et al. | 52/6 |
| 4,678,019 | 7/1987 | Esposito | 160/272 |
| 4,912,887 | 4/1990 | Sullivan | 52/7 |
| 4,939,875 | 7/1990 | Fujita | 52/7 |
| 5,022,200 | 6/1991 | Wilson et al. | 52/127.9 |
| 5,069,006 | 12/1991 | Fujita | 52/7 |

*Primary Examiner*—Neill R. Wilson

*Attorney, Agent, or Firm*—St. Onge Steward Johnston & Reese

[57] ABSTRACT

Reusable performance stage deck segments provide rapid assembly with assured alignment. Segments interlock to form a substantially continuous performance surface. The reusable segments have a top, a bottom (preferably with low-friction pads), a first pair of opposed sides, a second pair of opposed sides, and an upper deck surface supported by the top of the frame. Each pair of opposed sides on basic structural segments includes guide means to vertically align the sides with adjacent deck segments having complimentary guide means. Two types of guide means are provided, one also facilitates horizontal alignment, preferably by providing a projecting member (e.g., a removable tapered rod) on one side and a receptacle for a like member on the opposed side. The other type includes an elongated tongue element on one side and an elongated groove element on the other, to facilitate sliding movement between engaged complimentary members. Cable track deck segments include tracks for cables.

23 Claims, 15 Drawing Sheets

PERFORMANCE STAGE DECK AND ASSEMBLY METHOD

TECHNICAL FIELD

The present invention relates to a stage deck which provides a performance surface raised above a supporting stage and encloses cables, ropes, and related mechanisms for moving set components, and particularly to a deck of this type which is adapted to rapid assembly of the deck and arrangement of set components.

Theatrical performances enrich the human experience, lift the spirit, and convey significant ideas. The variety of performances, including drama, opera, classical theater, comedy, musical productions, and the like, provides subjects of interest to virtually everybody. Typically, however, each subject — indeed, each production — requires a specially designed stage deck. While artistic creativity can supply a seemingly endless succession of new performance ideas, the number of productions which can be brought to any given theater is limited by both cost and time. The construction and assembly of new decks are both expensive and time consuming.

New productions have typically required the construction of entirely new stage decks with a flat upper performance surface and a complex array of equipment, between the performance surface and a supporting stage, for moving set components over the surface. A well-designed stage deck can greatly enhance a production and its enjoyment. Set components must be moved rapidly and accurately during performances. The selection and arrangement of cables, ropes, pulleys, guides, motors, and like equipment will vary with each new production. But, when the run of performances is over, the decks will typically be completely disassembled with salvage only of the more valuable component parts. Most will be discarded.

The costs are similarly high for shows which are intended to travel from one location to another. Moreover, the speed of assembly of the deck and related set materials becomes of increasing importance as the frequency of movement increases. There is also a need to simplify the assembly process so that deck components will be properly aligned by crews unfamiliar with a particular set.

Until the present time there has not been a performance deck system which enabled the use of standardized deck units and was adapted to rapid and correct alignment and assembly, despite the presence of mechanisms for moving set components in controlled fashion over the deck surface.

DISCLOSURE OF INVENTION

It is an object of the invention to enable the rapid assembly of performance stage decks.

It is a further object of the invention to enable the construction of performance stage decks from standardized, reusable segments.

It is another object of the invention to reduce the cost of theatrical productions by enabling rapid assembly of stage decks from reusable segments.

It is another and related object of the invention to minimize the time required to assemble a stage deck while assuring proper alignment of deck segments.

It is yet another and related object of the invention, in one of its more particular aspects, to provide reusable performance stage deck segments.

It is yet another object of one of the more particular aspects of the invention to provide reusable stage deck segments including cable guides and openings for dogs to enable movement of accompanying set components in a defined pattern over the deck.

It is yet another and related object of the invention to provide a method for assembling a stage deck which employs reusable deck segments configured to provide rapid assembly with and proper alignment between standard and special purpose deck segments.

These and other objects are achieved by the present invention which provides a stage deck and a method for their assembly.

The performance stage deck of the invention comprises a plurality of interlocked deck segments which together form a substantially continuous performance surface. The segments of the invention comprise two general kinds: (1) a basic structural segment, and (2) a cable track segment. All of the deck segments have a top, a bottom, a first pair of opposed sides, a second pair of opposed sides, and an upper deck surface supported by the top of the frame. They also all provide guide means to assure vertical alignment. The basic structural segments comprise guide means on the first pair of opposed sides to vertically and horizontally align the sides with adjacent deck segments having complimentary guide means, and on the second pair of opposed sides to vertically align those sides with adjacent deck segments which include complimentary guide means. Lock means are provided to interlock adjacent deck segments. The cable track segments can be constructed with guides on only two opposed sides.

Preferably, the deck will comprise a plurality of standardized deck segments of regular size and shape and also a number of deck segments which have a specialized shape or function. Assembly of the individual deck segments into the deck is greatly facilitated by the inclusion of low-friction pads on the bottom of the frame to assure ease of movement over a supporting stage surface. In one preferred form, the guide means on the first pair of opposed sides of a standard deck segment will include an elongated alignment member (e.g., a removable rod having a tapered end) projecting from one side and a receptacle for a like elongated member on the other side. The receptable preferably has an outwardly-flared opening for receiving an elongated alignment member from an adjacent deck segment.

To facilitate movement of the above-mentioned guide means into the desired positions, the second pair of opposed sides desirably include guide means which comprise an elongated tongue element on one side and an elongated groove element on the other, both such elements having low friction surfaces to facilitate sliding movement between engaged complimentary members on adjacent segments.

The deck is intended as the surface on which all entertainment action takes place. It must be strong enough to support the events planned and provide an essentially continuous surface so as to avoid snagging objects or trip performers moving over it. In its preferred form, the upper surface of each deck segment is covered by a flat sheet which extends over the sides of the frames sufficiently to conceal the guide means and provide an essentially continuous surface between adjacent deck segments.

A particular advantage of the decks of the invention is that standardized, reuseable segments can be rapidly, accurately aligned and locked into place even in decks which include cable track segments including one or more tracks for supporting cables between the top and bottom of the frame. In a preferred form, the upper surface of the deck will include at least one elongated opening above a track, to permit movement of a dog (and objects connected to it) across the deck surface.

The method for assembling a performance stage deck according to the invention comprises: (a) providing at least two reusable deck segments as defined above; (b) sliding the segments over the surface of a stage to engage complimentary guide means on the two deck segments; and (c) engaging the lock means to interlock the two deck segments.

BRIEF DESCRIPTION OF THE DRAWINGS

The invention will be better understood and its advantages will be better appreciated from the following detailed description, especially when read in light of the accompanying drawings wherein.

DESCRIPTION OF THE PREFERRED EMBODIMENT

The invention will be described below with reference to a representative embodiment which illustrates the principal features of the invention in terms of essential structure and operation, while not relating detail of any particular set arrangement. Each new show will typically require customized deck segments, often including turntables and the like, along with the standardized units of the invention.

Figure 1:
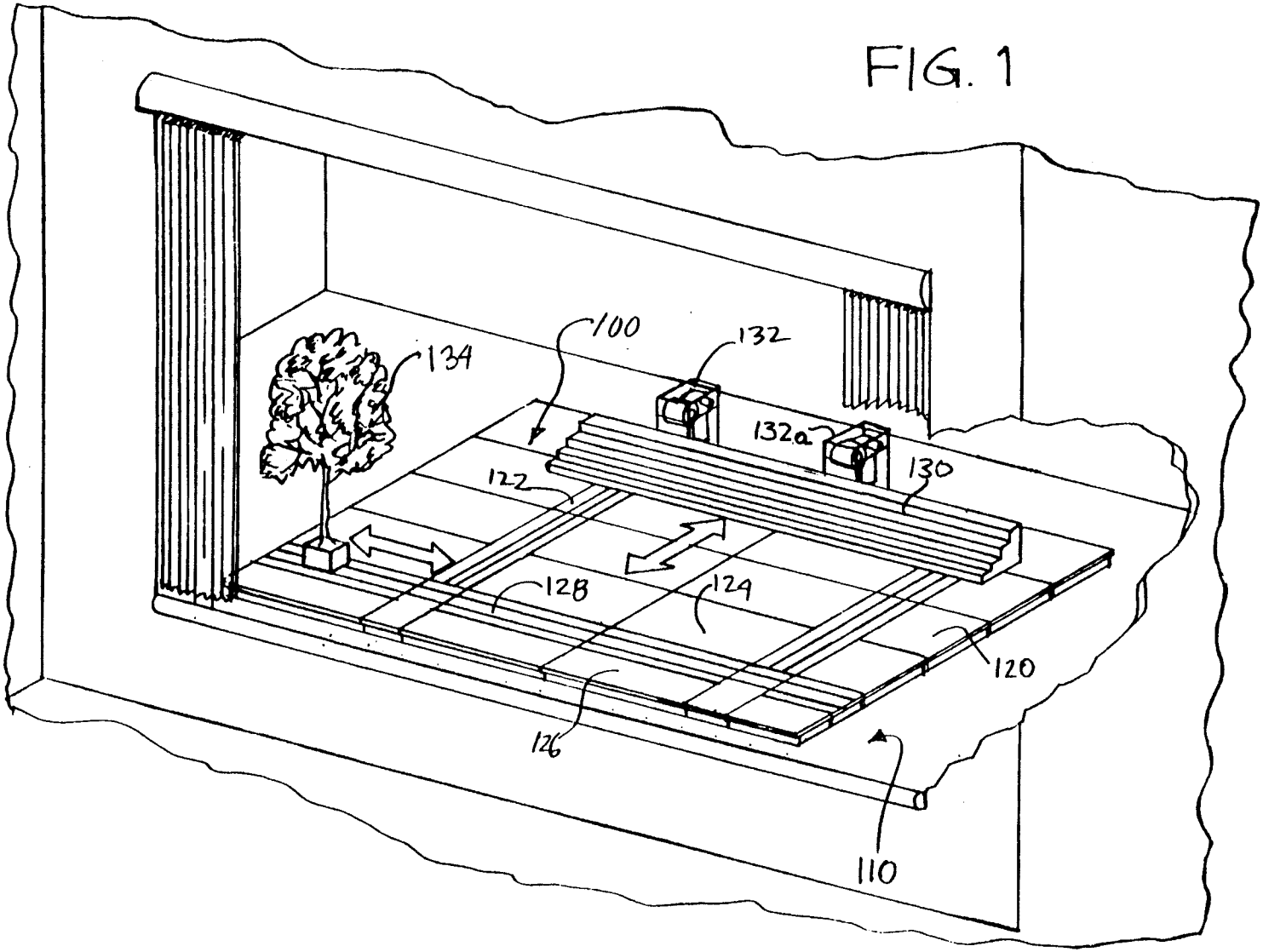
FIG. 1 is a perspective view showing a preferred embodiment of the performance stage deck system of the invention in one fully-deployed configuration.

FIG. 1 is a perspective view showing a preferred embodiment of a performance stage deck system of the invention in one fully-deployed configuration 100 on a theater stage 110. The stage 110 can be of either permanent construction or of the kind assembled for temporary use. The assembled deck 100 is comprised of a plurality of interlocked deck components (e.g., 120, 122, 124, 126, and 128) having a variety of shapes and functions. The deck is shown with a set of stairs 130, of the type often employed for choral or dance arrangements. These are adapted to be moved from front to back (as indicated by the arrow) by a series of cables and cable guides located under the upper surface. Motive force is provided by powered capstans 132 and **132*a*. A tree 134** is illustrated as representative of a typical set component which can be adapted for movement across the deck surface (in the direction of the arrows) by a dog which protrudes through an elongated opening in the deck surface. The details of each of these features will be described in greater detail below.

The individual deck segments fit together to provide an essentially continuous surface. There are breaks in the surface caused by the joints between the individual upper surfaces of the segments and the openings necessarily provided for moving set components. However, it is an advantage of the invention that the individual deck segments can be rapidly aligned with high precision in the vertical direction. This provides an essentially continuous, planar surface with adjacent segments mated neatly so that there are no major gaps or openings which could disrupt the movement of set components or performers thereover. Thus, the surface is continuous in the sense that it permits continuous movements across it.

Figure 2:
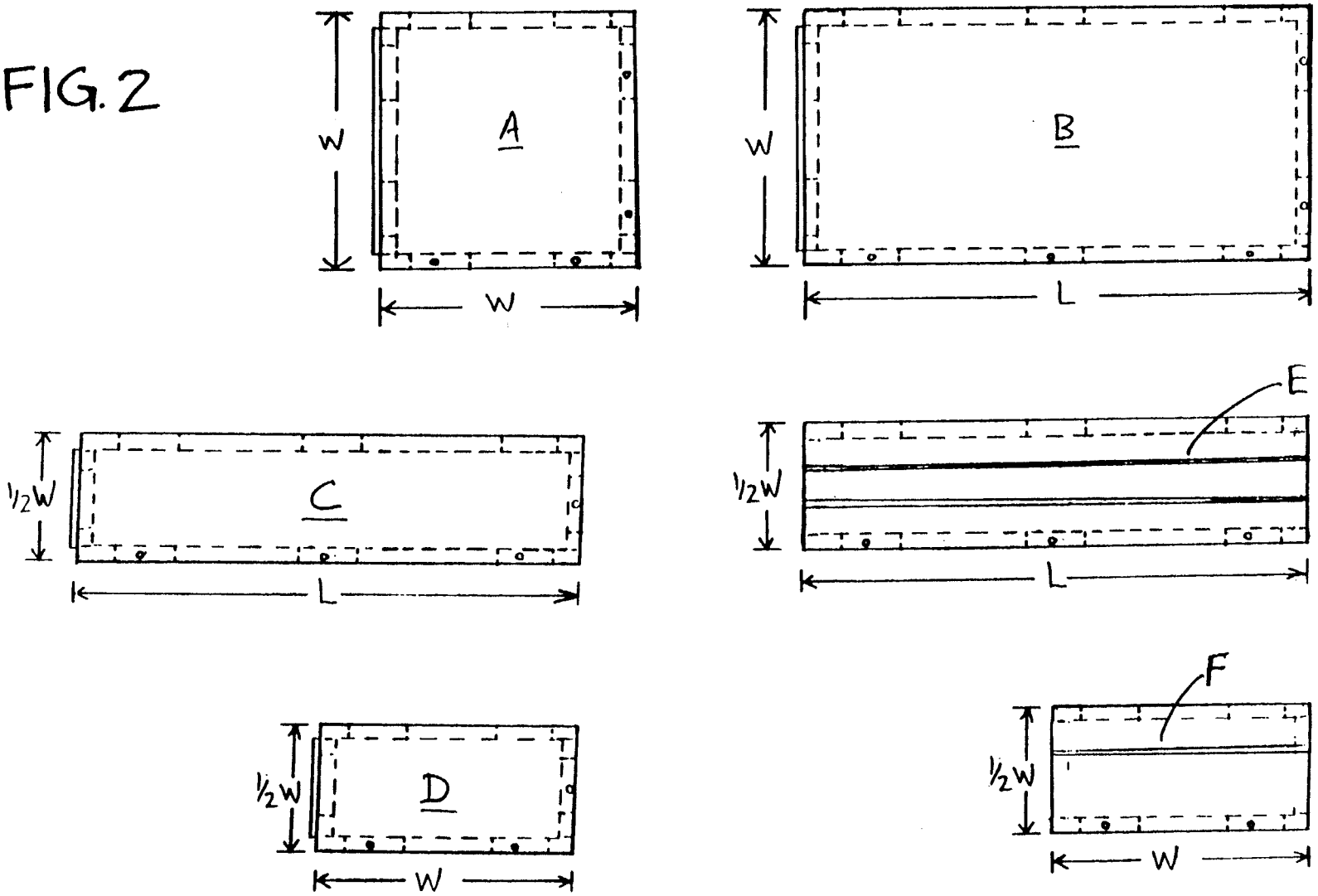
FIG. 2 presents top plan views of six different reusable deck segments, A through D being basic structural segments and E and F being cable track segments.
Figure 3:
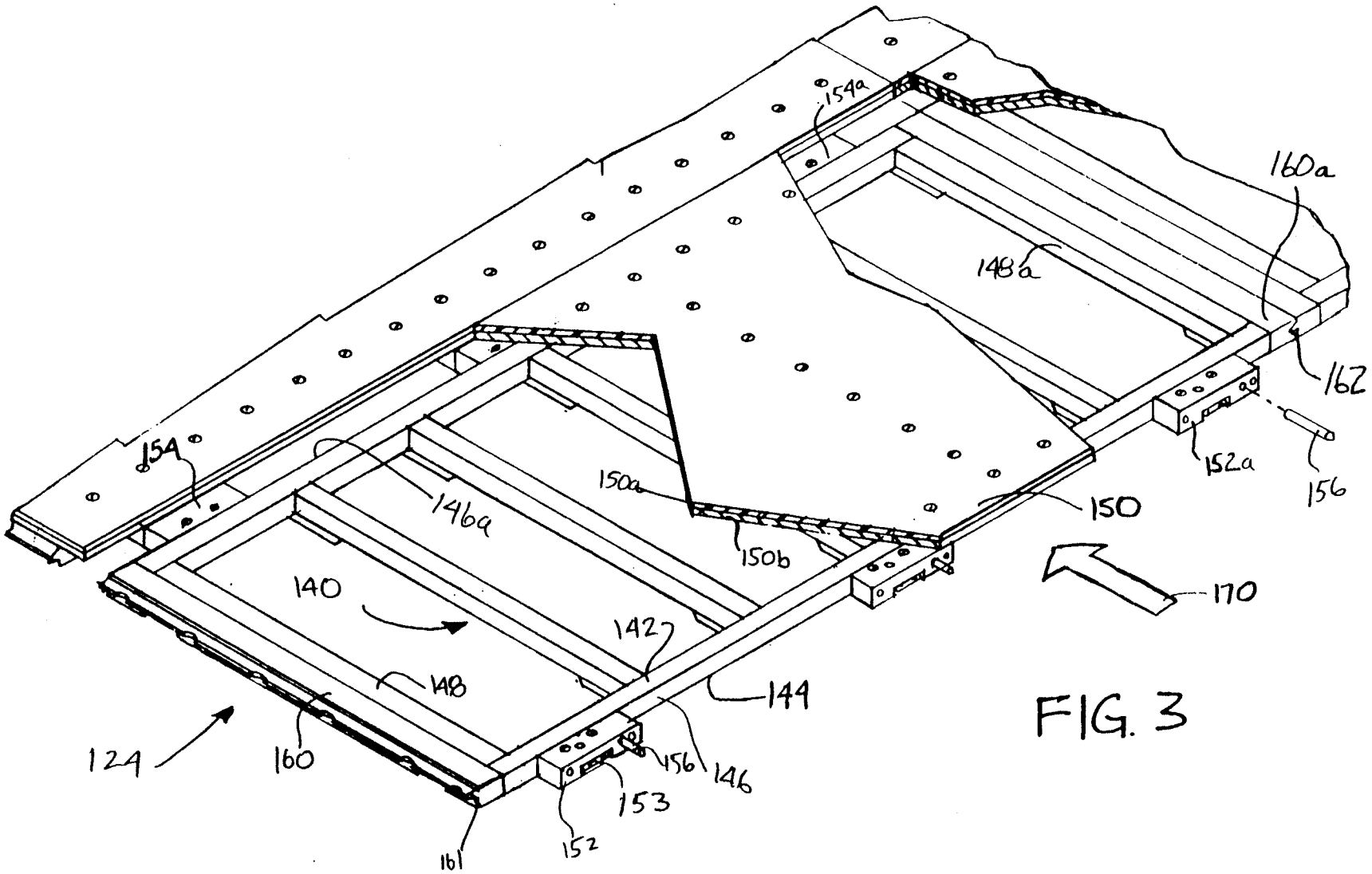
FIG. 3 is a perspective view of a preferred form of a single basic structural segment with the top surface partially broken away.

FIG. 3 is a perspective view of a representative reusable, basic structural deck segment of the invention, similar to segment 124 in FIG. 1 and to segment B in FIG. 2. As can be seen from these figures, ease of assembly is facilitated by employing at least some deck segments with a length L which is twice the width W as in the basic shape of segment B in FIG. 2. The more preferred forms of the invention will employ as many reusable deck segments as possible with these dimensions or multiples or divisions of these. In one preferred embodiment, the standard dimensions for a basic unit of this type is approximately four feet by eight feet.

The basic deck segment 124 in FIG. 3 is shown partially broken away and in alignment with other deck segments on two sides. At least two segments of this type are interlocked, with as many other deck segments as necessary, to form the stage deck having a substantially continuous performance surface in the areas which require this for movement of set components and performers. Each segment of this type typically comprises: a frame 140 including a top 142, a bottom 144, a first pair of opposed sides 146 and 146*a*, a second pair of opposed sides 148 and 148*a*; and an upper deck surface 150 supported by the top 142 of the frame. Desirably, low-friction pads 151 (see FIG. 9), constructed of a material such as ultra high molecular weight polyethylene (UHMWP), are affixed to the bottom 144 of the frame at sufficient locations to provide support and facilitate sliding movement of the deck segments across a supporting stage surface. Lock means 153 are provided to interlock aligned sides of adjacent deck segments.

The frame 140 is made of a suitable material of construction, such as steel, to provide the strength and structural integrity necessary for the production intended. The drawings show the frame to be constructed of welded square tubular steel perimeter and cross braces. For some productions, it may be desired to use a lighter material and combinations of various low weight materials such as aluminum, wood, honeycomb structural panels, and the like can be employed.

Guide means are provided on the first pair of opposed sides (152 and 152*a* on side 146, and 154 and 154*a* on side 146*a*) to vertically and horizontally align those sides with adjacent deck segments having complimentary guide means. Guide means 152 an 152*a* on side 146 include an elongated alignment member 156 projecting from one side (e.g., side 146 in FIG. 3) and a receptacle 158 (see FIGS. 6A and 6B) for a like elongated member on the other side. Recepticle 158 preferably includes an outwardly-flared opening 158*a* (best seen in FIGS. 6A and B) for receiving an elongated alignment member of an adjacent deck segment. For ease of production and to provide greater flexibility of assembly, each of the guide means is provided with suitable openings to permit its functioning as either the male or the female member in a pair.

The elongated alignment member 156 is shown to comprise a removable rod having a tapered end projecting from guide means 152 and 152*a* on side 146. The body of each of the guide means is formed from a block of a suitable material, such as UHMWP, which is rugged and has a desirable low-friction surface to facilitate alignment and assembly.

Guide means are also provided on the second pair of opposed sides (e.g., 160 on side 148 and 160*a* on side 148*a*) to vertically align those sides with adjacent deck segments having complimentary guide means. Guide 160 is shown as including an elongated tongue element 161 and guide 160*a* is shown as an elongated groove element 162. Both the tongue element 161 and the groove element 162 preferably have low friction surfaces to facilitate sliding movement between engaged complimentary members on adjacent segments. Accordingly, these elements are also desirably constructed from UHMWP.

The distinct guide structures of the elements affixed to adjacent sides (such as sides 146 and 148) greatly facilitates alignment and assembly. This can be visualized by viewing FIG. 3 where arrow 170 indicates the direction in which deck segment 124 was moved to align it with the other deck segments and the direction in which the next deck segment will be moved to join it with segment 124. Because guide pairs 152 and 154 include at least one rod-like member 156 which must move linearly in the direction of the arrow 170, the guides on adjacent sides cannot also include elements of this kind because this would require linear movement in the direction transverse to that for guide pairs 152/154. The tongue and groove arrangement of guide pairs 160 and 160*a* facilitate alignment and assembly by simple linear sliding movements.

The sheets forming the upper surface 150 are preferably dimensioned to overhang the sides of the frames sufficiently to cover the guide means and provide an essentially continuous surface between adjacent deck segments. The top surface is shown to be formed in two layers, 150*a* and 150*b*, which can be for example ¼ to ½ inch sheets of plywood and/or Masonite TM structural board. The top sheet 150*a* will preferably be ⅜ inch A/C grade plywood. They are shown to be screwed into place, but other suitable fastening can be employed.

Figure 4:
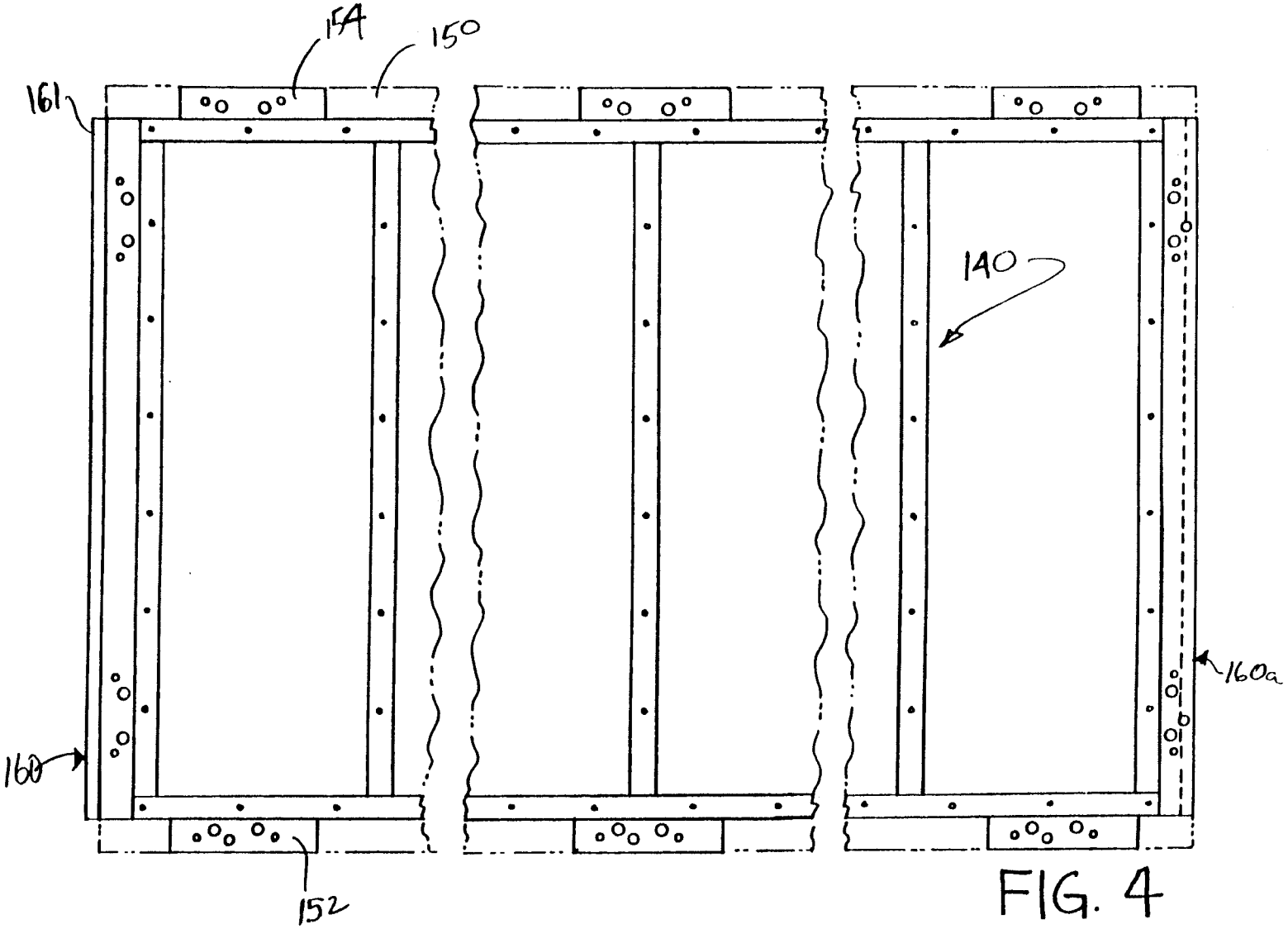
FIG. 4 is a top plan view of a deck segment as shown in FIG. 3 with the upper surface removed and broken in the long dimension to better show structure of the frame and positioning of alignment means.

FIG. 4 illustrates in phantom lines the placement of a typical basic deck segment upper surface sheet 150 over an underlying frame structure 140. The surface sheet 150 is shown here to cover the entire extent of guides 152 and 154 (excluding the rods 156 which are not shown). Sheet 150 also covers guide 160*a* and all of 160 except the tongue portion 161 which will be enclosed by the groove portion of a complimentary member such as 160*a* on an aligned side of an adjacent deck segment.

Figure 5A:
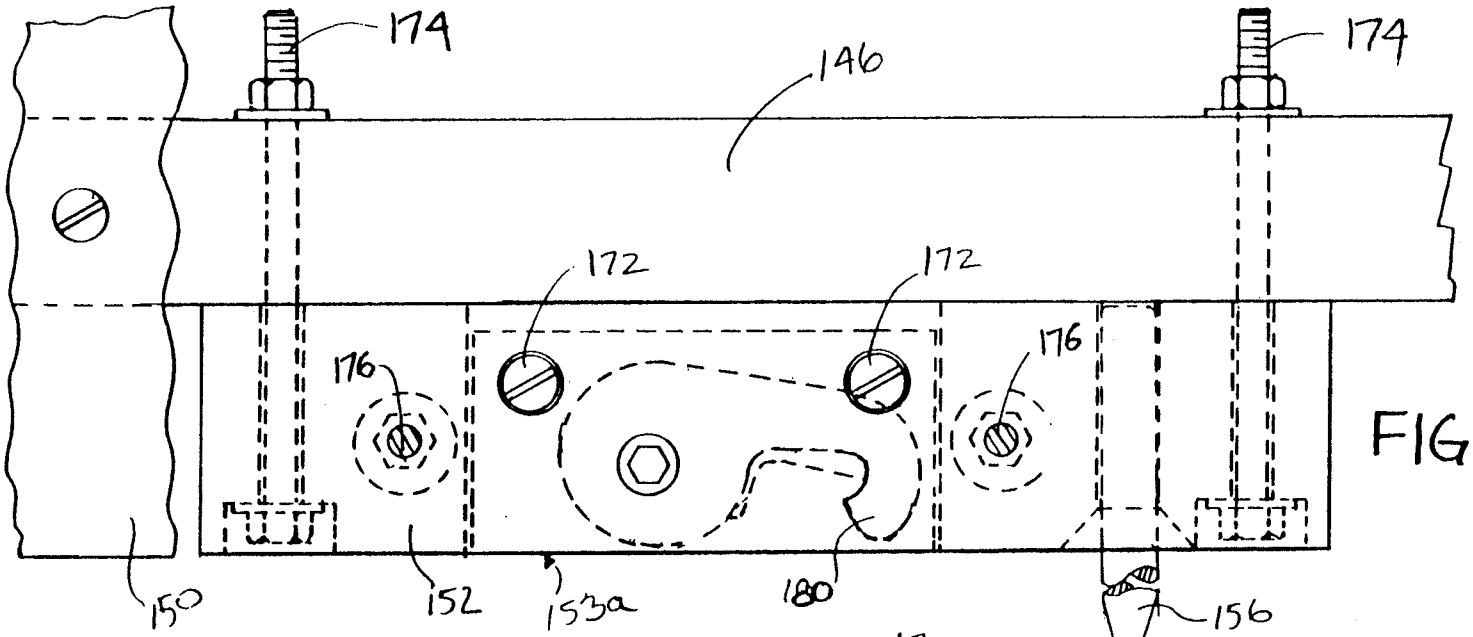
FIG. 5A is top plan view with upper deck surface partially broken away to show a preferred arrangement of a guide means typically employed on a long side of a deck segment as shown in FIG. 3 and includes in phantom lines a male half of a preferred form of locking mechanism.
Figure 5B:
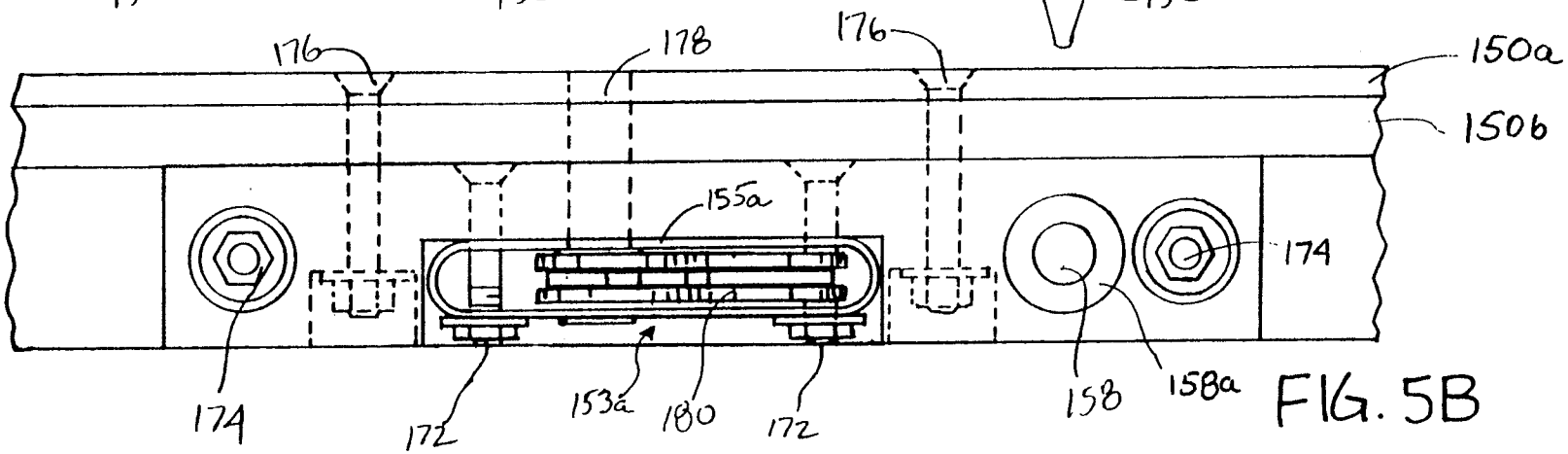
FIG. 5B is a side elevation view of the mechanisms shown in FIG. 5A.
Figure 6A:
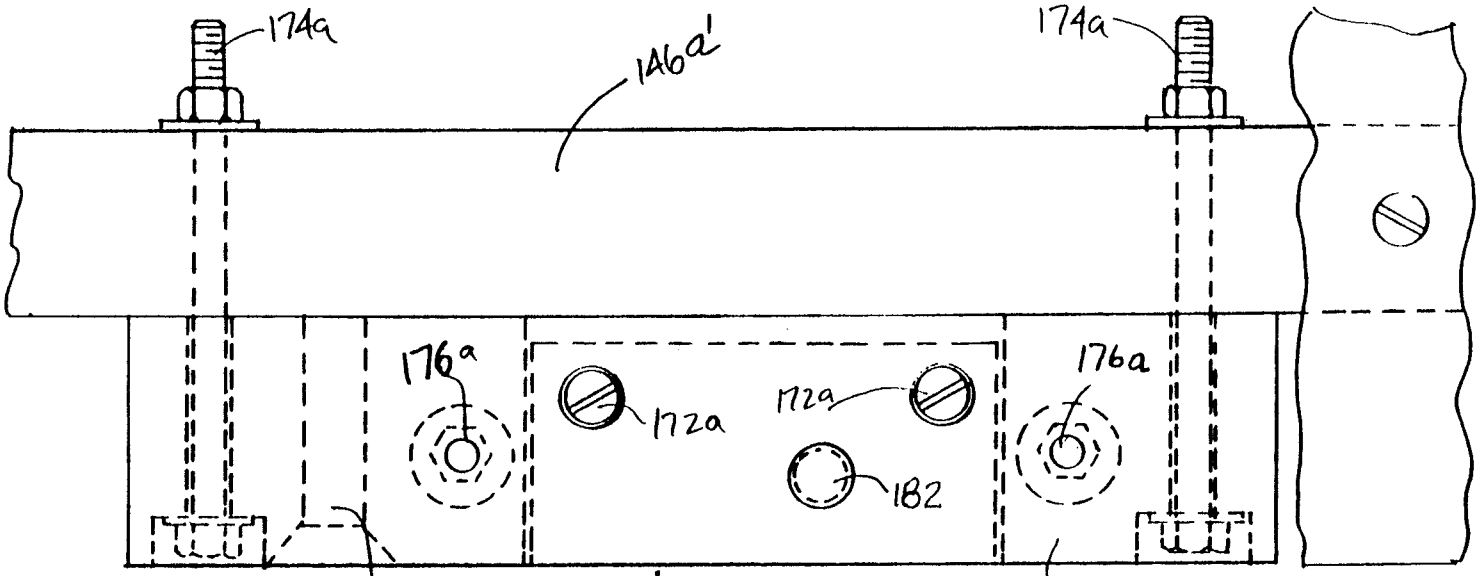
FIG. 6A is a top plan view similar to FIG. 5A showing a mechanism complimentary with that of FIG. 5A.
Figure 6B:
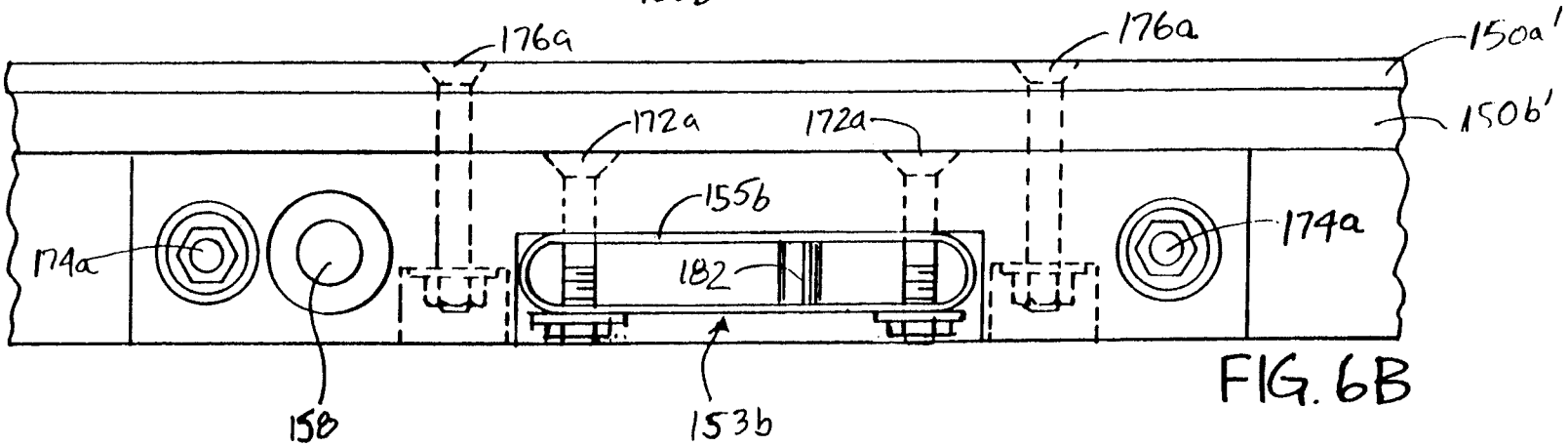
FIG. 6B is a side elevation view of the mechanism shown in FIG. 6A.
Figure 7:
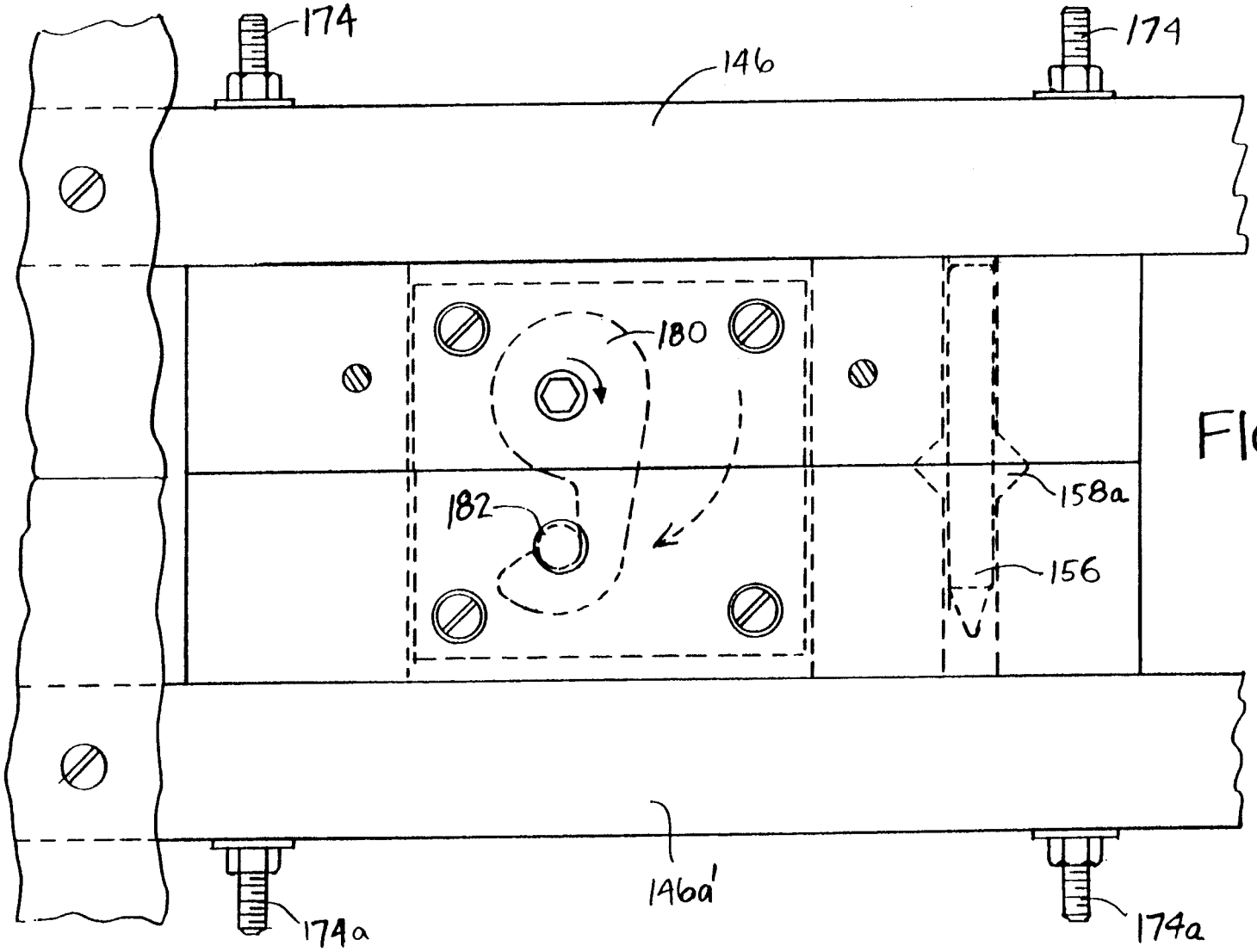
FIG. 7 is a top plan view showing the locking of the mechanisms illustrated in FIGS. 5A&B and 6A&B.

FIGS. 5A and 5B show a preferred arrangement of a guide means 152, typically employed on a long side (e.g., 146) of a deck segment as shown in FIG. 3 and includes in phantom lines a male half 153*a* of a preferred form of locking mechanism. FIG. 6A is a top plan view similar to FIG. 5A showing a guide 154 and female half 153*b* of lock mechanism 153 which are complimentary with those of FIG. 5A, and FIG. 6B is a side elevation view of the structure shown in FIG. 6A. FIG. 7 is a top plan view showing the locking of the mechanisms illustrated in FIGS. 5A&B and 6A&B.

The top plan view in FIG. 5A shows upper deck surface 150 partially broken away to clarify the view which also shows male locking member 153*a* and various holes and bolts in phantom lines. FIG. 5B shows these mechanisms in side elevation. The body 155*a* of male lock half 153*a* is shown bolted (bolts 172) to the body of guide 152 which is in turn bolted to frame 146 (bolts 174) and to top sheets 150*a* and 150*b* (bolts 176). Bolting is a convenient, structurally sound fastening method, but any other suitable means can be employed. A hole 178 extends through the top sheets to permit a suitable key to be inserted in to male lock half 153*a* for locking. Rotation of the key, in this case a rod with a hexagonal cross-section, will rotate the latch hook 180 between the unlocked position shown in FIG. 5A and the locked position shown in FIG. 7. The lock will preferably be one such as a Simmons dual lock which provides locking integrity in the vertical and the horizontal directions.

FIGS. 6A and 6B illustrate guide and locking mechanisms complimentary to those shown in FIGS. 5A and 5B. Female lock half 153*b* includes a latch post 182 about which the latch hook 180 of the male half lock 153*a* can be rotated to engage the lock halves in the locked position and thereby interlock adjacent deck segments. The body 155*b* of the male half lock 153*b* is bolted (bolts 172*a*) to complimentary guide 154' of a complimentary deck segment which in turn is bolted to an adjacent side 146*a'* (bolts 174*a*) and to top sheets 150*a'* and 150*b'* (bolts 176*a*) of that other deck segment.

Figure 8:
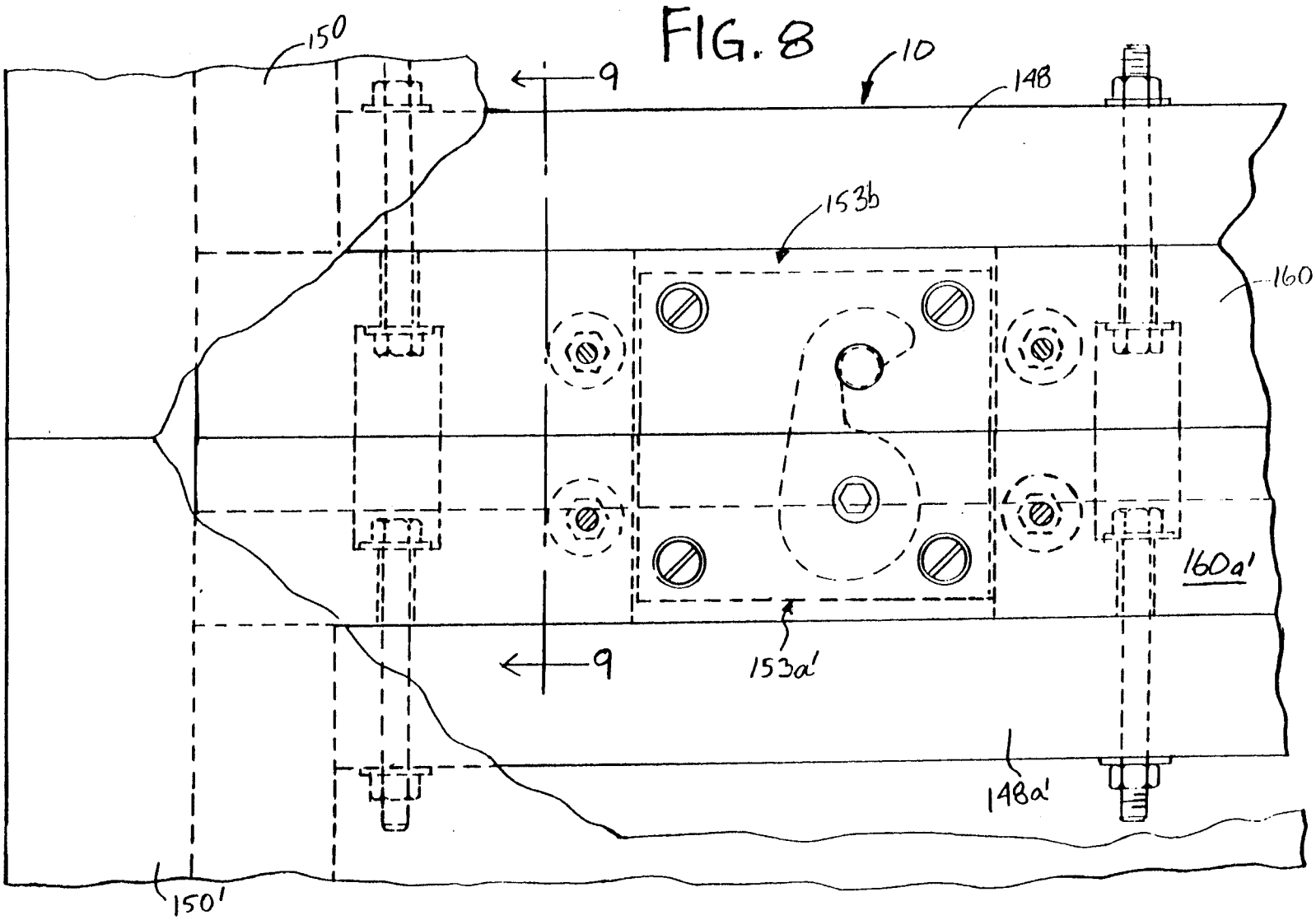
FIG. 8 is a top plan view of a locking mechanism similar to that shown in FIG. 7, but here shown locking two adjacent panels along sides having guide means similar to those on the shorter sides of the panel shown in FIG. 2.
Figure 10:
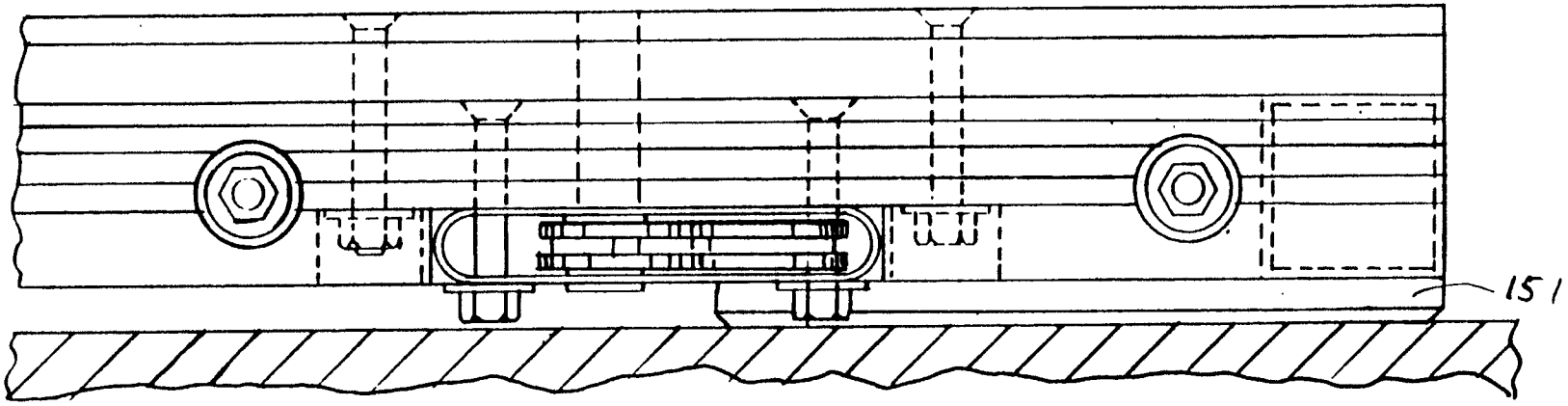
FIG. 10 is a side elevation view of a portion of the female guide member shown in FIG. 8, showing the locking mechanism in the unlocked position.
Figure 9:
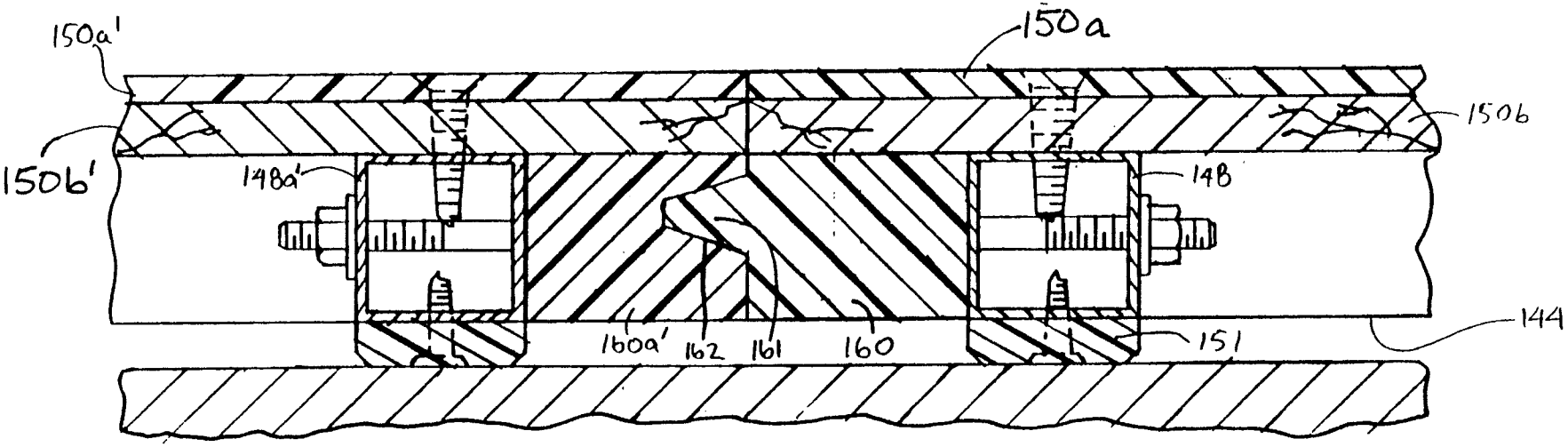
FIG. 9 is a cross-sectional view taken along line 9—9 in FIG. 8.

FIG. 8 is a top plan view of a locking mechanism similar to that shown in FIG. 7, but here shown locking two adjacent panels along sides having guide means similar to those on the shorter sides of the panel shown in FIG. 2. FIG. 9 is a cross-sectional view taken along line 9—9 in FIG. 8. FIG. 10 is a side elevation view of a portion of the female guide member shown in FIG. 8, showing the locking mechanism in the unlocked position.

Guide means 160 on side 148 and 160*a'* on side 148*a'* are configured to slide by one another while engaged to vertically align those sides of the adjacent deck segments. Guide 160 is shown as including an elongated tongue element 161 and guide 160*a'* is shown as including an elongated groove element 162. These guide means are bolted to their respective deck sections at the sides as indicated in similar fashion to the guide means already discussed. The lock halves 153*a'* and 153*b* are essentially as previously described, and are bolted to the guide means in similar fashion to that discussed. It should be noted that the tongue and groove elements of these guides are raised above the centerline of the guides to leave room for the locks in the embodiment shown. It is preferred to employ at least two locking mechanisms along each pair of adjoining sides. Reference back to FIG. 4 shows guide means provided with locations for two locks on each of the short sides and for three on the long sides. Other arrangements will be effective in other deck configurations. FIGS. 9 and 10 also illustrate low-friction pads 151 affixed to the bottoms of the frame members at suitably spaced locations. This feature, along with the guide means which provide ready sliding movement between adjacent deck sides during alignment, also enhances alignment by reducing a major source of resistance to movement and, thereby, resistance to proper alignment.

A deck of the type shown in FIG. 1 will also include at least one deck segment comprising a track for supporting cables between the top and bottom of the frame. A cable track segment of this kind will include at least one elongated opening above a track, the opening being adapted to permit movement of a dog along that opening and thereby enable moving objects connected to said dog across the performance surface. Reference to FIGS. 11 through 19 illustrate representative cable track segments and their assembly and operation in a completed stage deck.

Figure 11:
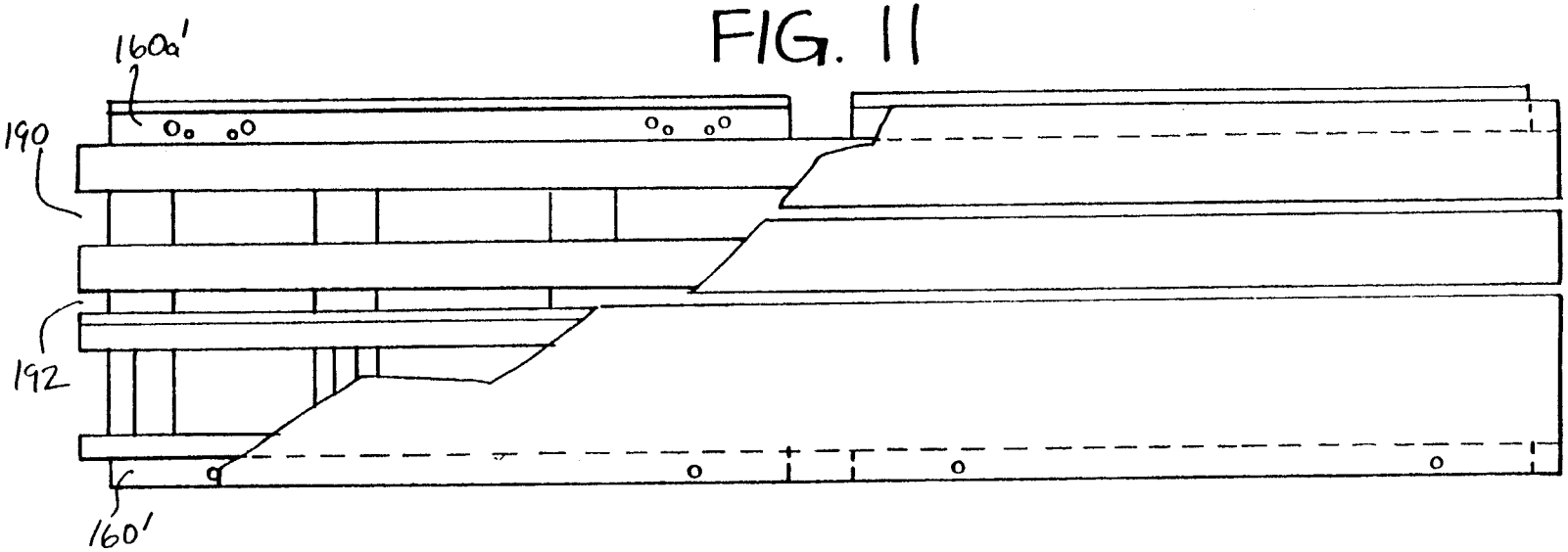
FIG. 11 is a top plan view of a cable track deck segment which employs guide means of the type shown in FIG. 8 and includes guides for cables and has elongated openings in the upper surface (partially broken away) to provide access to drop the cables in during assembly and to enable a dog to extend therethrough.
Figure 12:
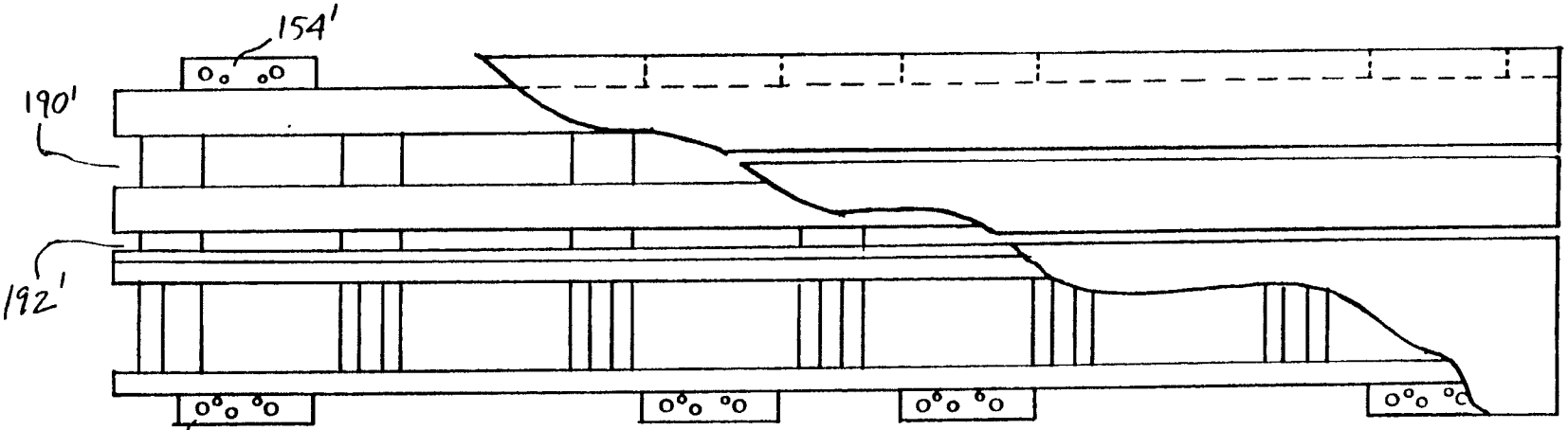
FIG. 12 is a top plan view of a deck segment similar to that shown in FIG. 11, but employing guide means similar to those illustrated in FIGS. 5A&B and 6A&B.

FIGS. 11 and 12 illustrate two embodiments of cable track deck segments according to the invention. The track segment in FIG. 11 includes guides 160' and 160*a'* along its long sides, these being of the type illustrated in FIG. 3 as guides 160 and 160*a*. The track segment shown in FIG. 12 shows guides 152' and 154' of the type shown in FIG. 3 as guides 152 and 154 along its two long sides. The short sides of each of these segments are configured to leave tracks 190 and 192 free of any obstruction for free movement of cables (not shown) between the top and the bottom of the segment. Accordingly, guide means are not provided on the short sides in this embodiment. These segments can still be securely interconnected with adjacent deck segments by virtue of their being interlocked along their long sides to segments having both guides and locks. The structural integrity of such an arrangement can be seen, for example, from FIGS. 1 and 15 wherein all adjacent edges of the individual deck segments are interlocked except for the short sides of the track segments.

Figure 13:
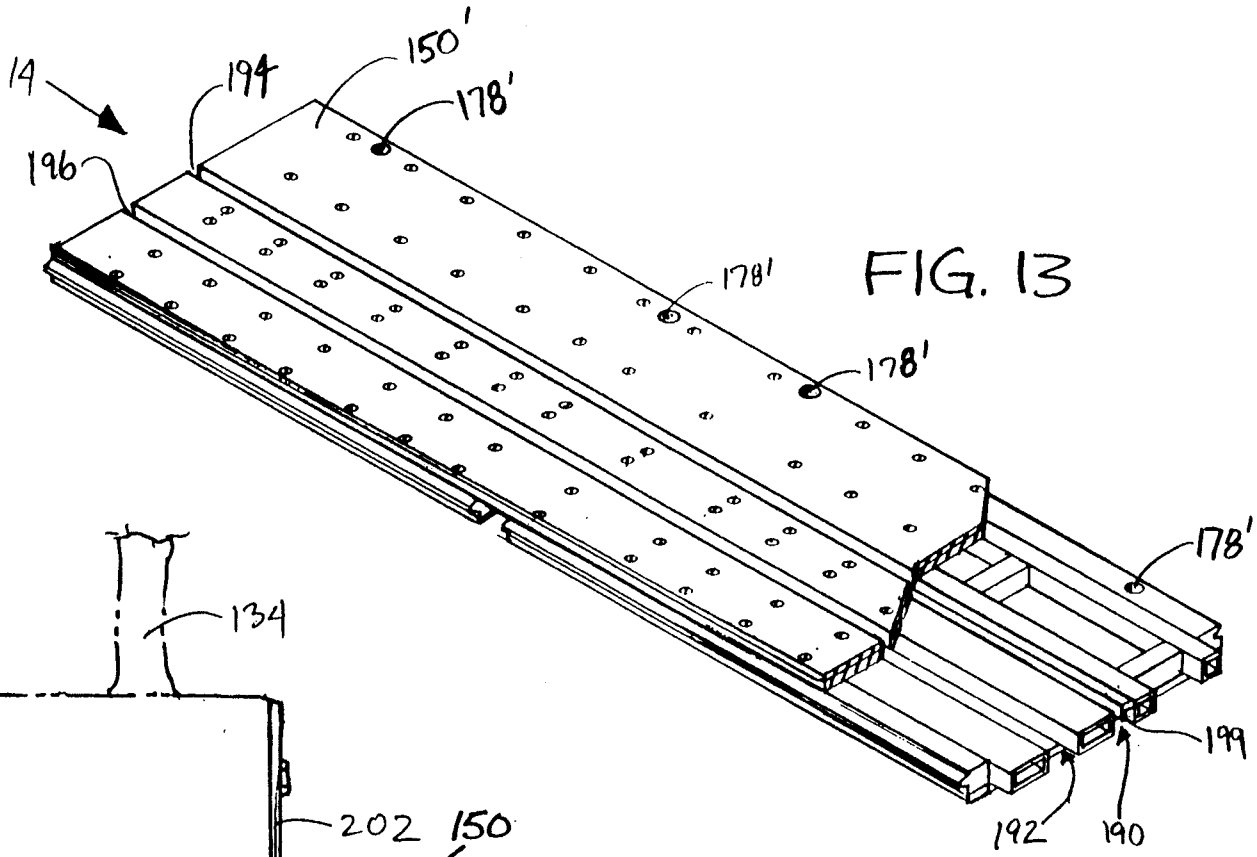
FIG. 13 is a perspective view showing a deck segment similar to that shown in FIG. 11.
Figure 14:
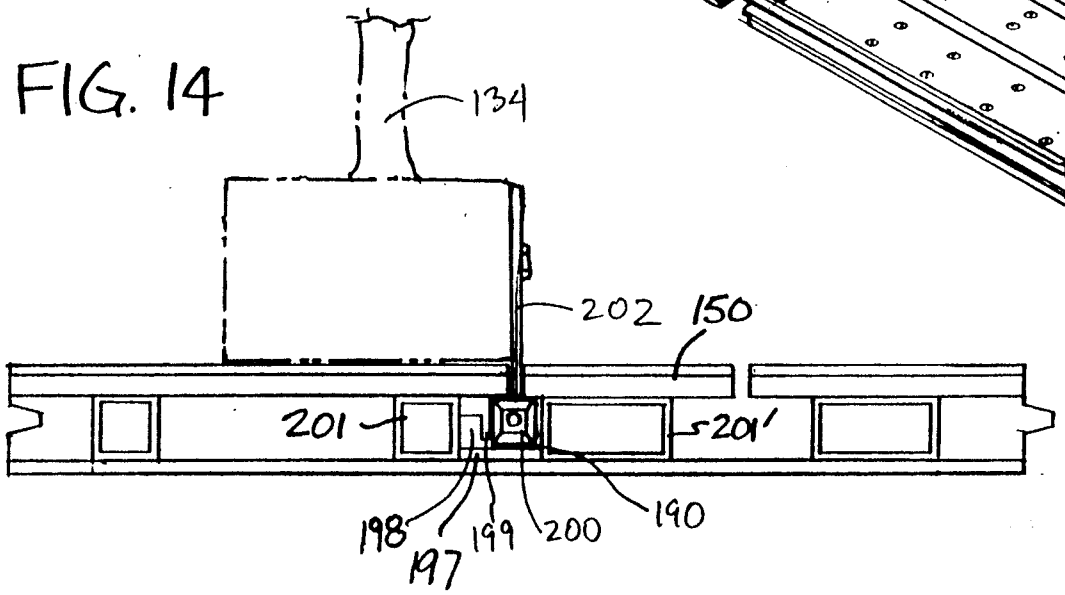
FIG. 14 is a side elevation view of the deck segment shown in FIG. 13, as viewed in the direction of arrow 14, but also illustrating a dog attached to a tree for use as scenery and adapted to be moved across the upper surface of the deck.
Figure 15:
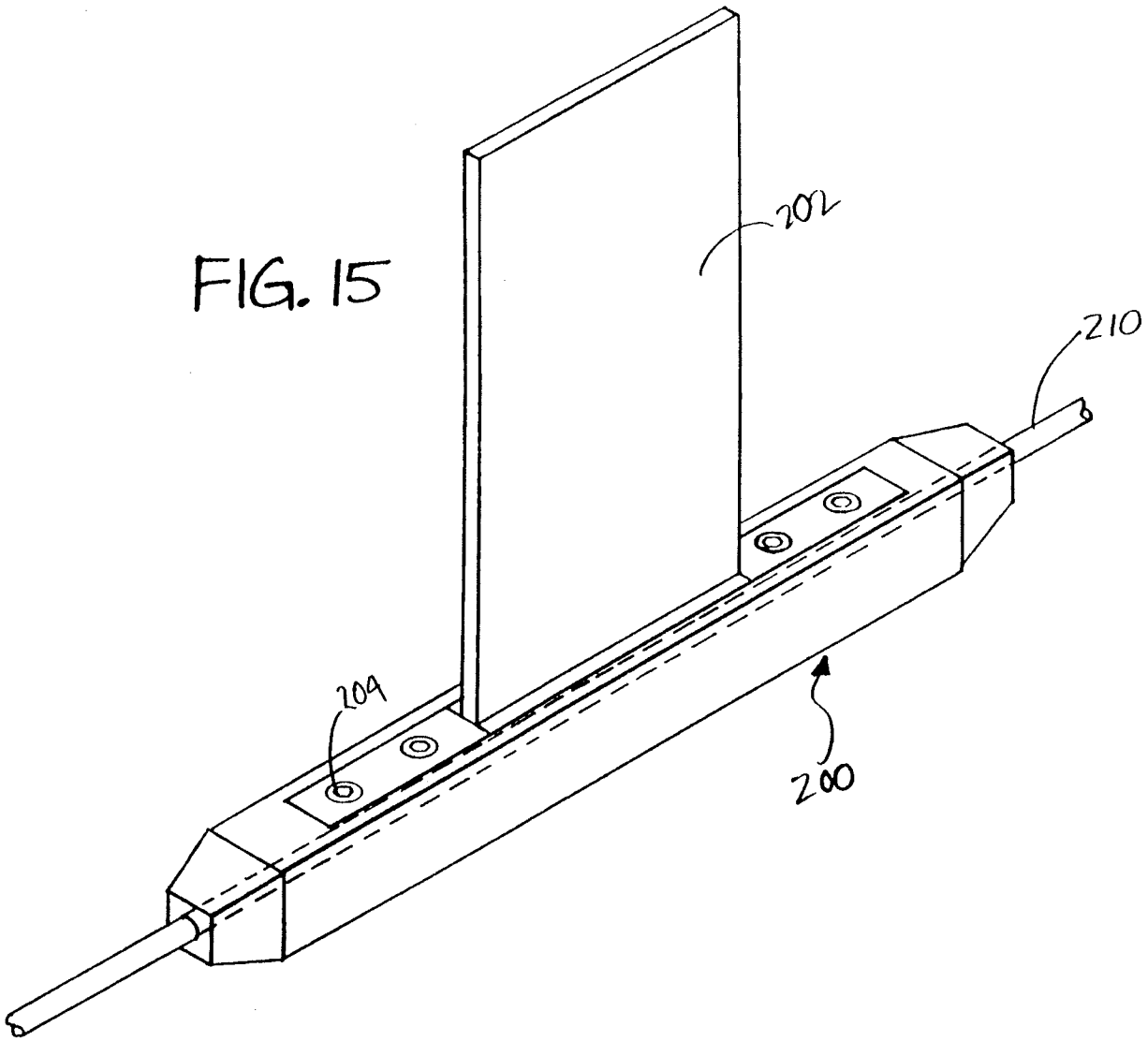
FIG. 15 is a perspective view of a dog of the type shown in use in FIG. 14.

FIG. 13 shows a track segment in perspective with the upper surface 150' partially broken away to show a representative frame structure. A plurality of holes 178' are provided to enable actuation of the locks in the manner 20 described. Above track 190 there is shown an elongated opening 194 in the upper surface 150', and above track 192 there is shown another elongated opening 196. FIG. 14 shows the track segment of FIG. 13 from the edge in the direction of arrow 14 in FIG. 13. From this perspective, a protected cable return 198 can be seen. FIG. 14 shows track 190 to be defined as a tunnel formed from a horizontal flat metal bar 197 on the bottom, by metal tubes 201 and 201' on opposite sides and by the underside of the upper surface 150. Thus, dog 200 can be seated in track 190 and be moved through it by attachment to a cable as shown in FIG. 15 without causing frictional contact with the return cable which can be protected while run through cable return 198.

This arrangement is particularly advantageous because it is fully compatible with the rapid alignment and assembly intended for the entire stage deck. In operation, the deck segments are slid across a stage, aligned, and locked into place. The cables are then simply dropped through the elongated top openings and quickly oriented in the main track portion or the return. To position the cable in the protected return, it is pushed below downwardly projecting lip 199. For connecting the dog 200 and connecting set components such as tree 134 to it, the dog can be slid into the desired track before final assembly and affixed to a riser 202 by turning set screws 204.

Figure 16:
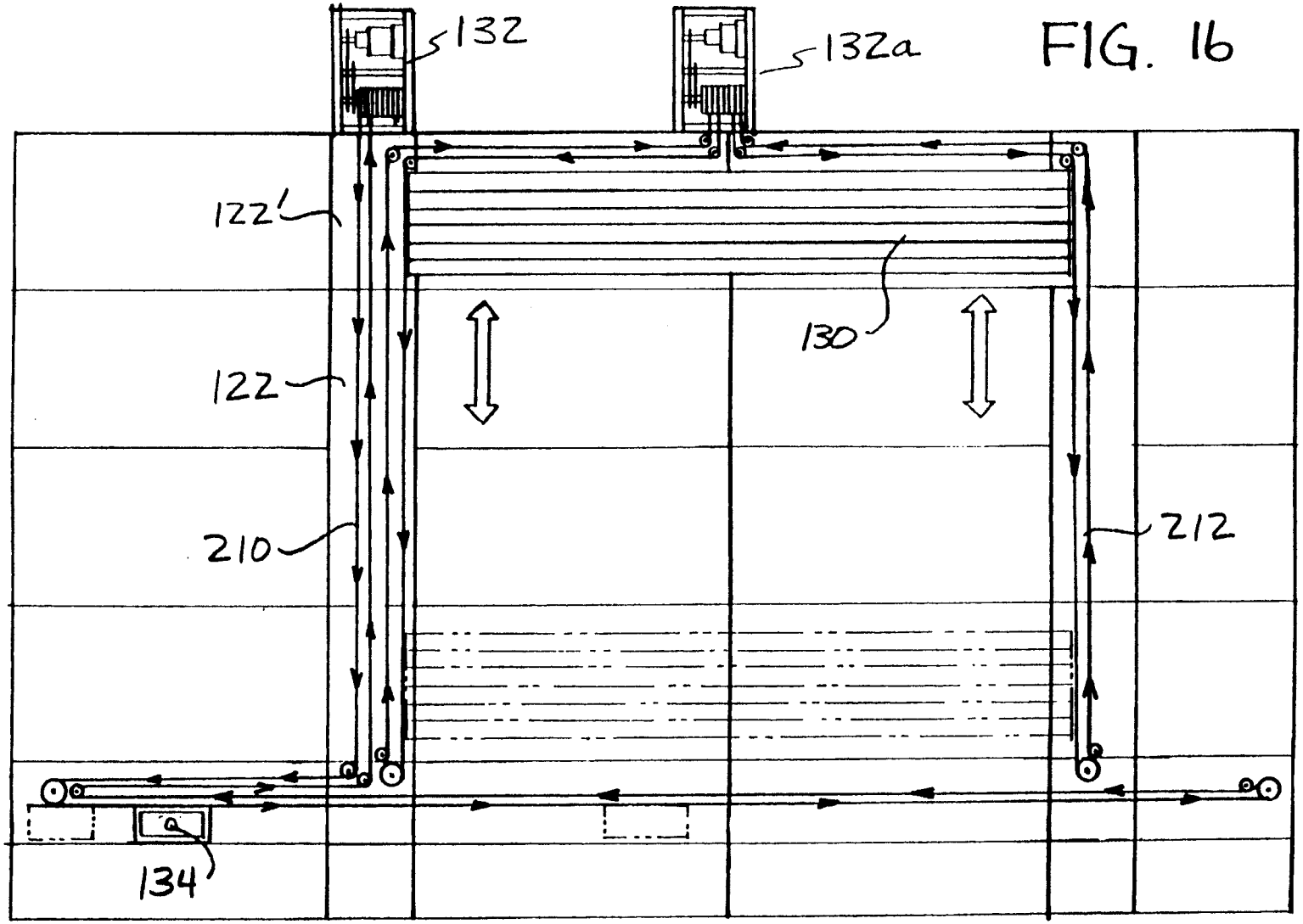
FIG. 16 is a top plan view of a portion of the top surface of the assembled performance stage deck shown in FIG. 1, showing a general arrangement of set components moveable over the deck surface.
Figure 17:
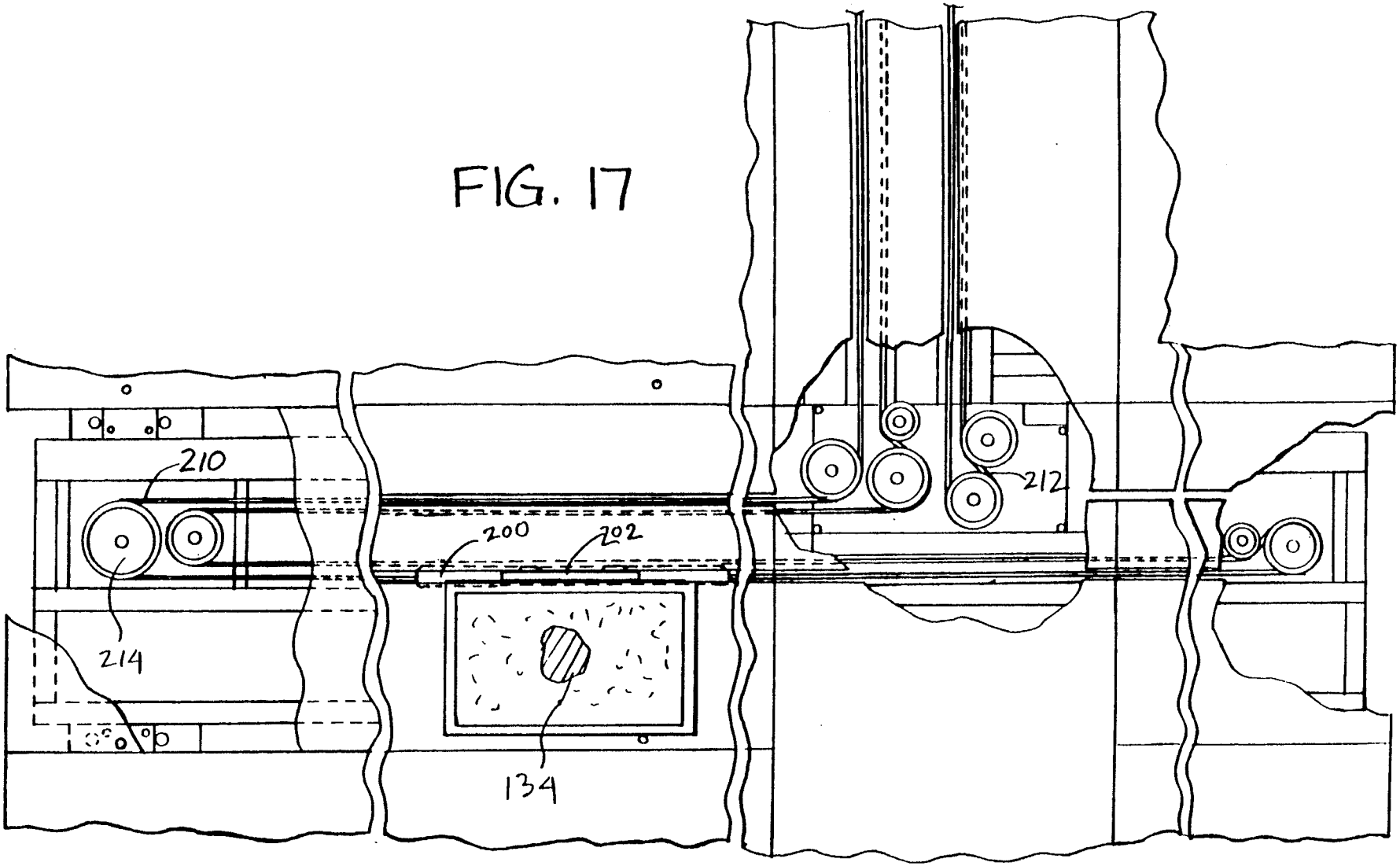
FIG. 17 is a top plan view of a smaller portion of the top surface shown in FIG. 16, partially cut away to show in greater detail a representative arrangement of cables and guide means.

The adaptation of track segments and their associated means for moving set components over the surface of an assembled deck can be better understood from viewing FIGS. 16 through 19. FIG. 16 is a top plan view of a portion of the top surface of the assembled performance stage deck shown in FIG. 1, showing a general arrangement of set components (such as stairs 130 and tree 134) moveable over the deck surface. FIG. 17 is a top plan view of a smaller portion of the top surface shown in FIG. 16, partially cut away to show in greater detail a representative arrangement of cables 210 and 212 and guide means (e.g., pullies 214 and the like). It will be noticed that cable 210 extends from the rear of the deck to stage left, across the stage to stage right, back across the stage to stage left, and back to the rear of the deck. FIG. 16 shows an arrangement where powered capstans 132 and 132*a* are assembled with the deck to provide motive force for moving the cables and, thereby, the set component connected thereto.

Figure 19:
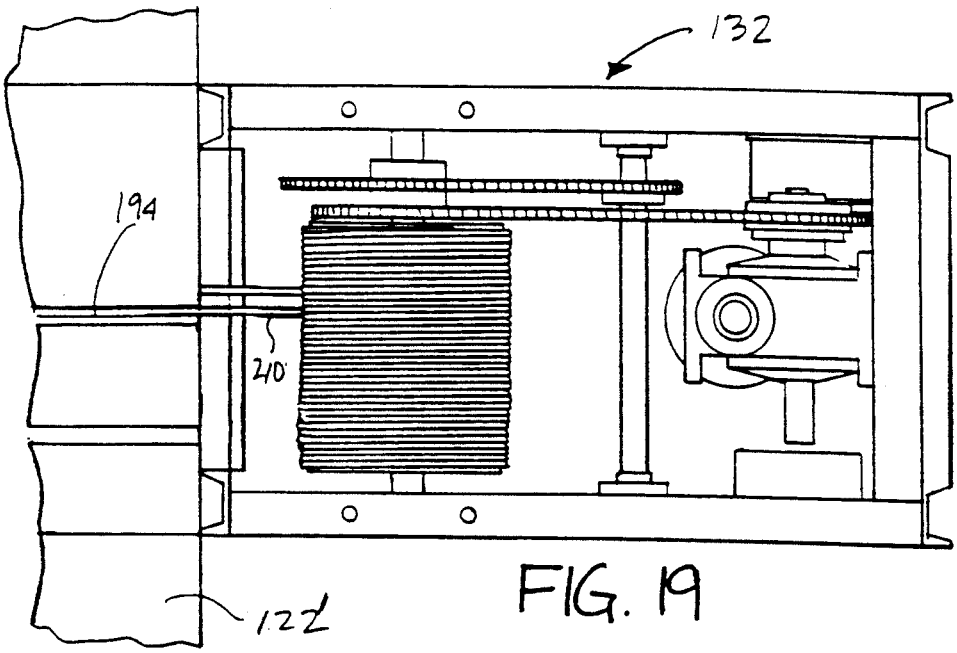
FIG. 19 is a top plan view of a powered capstan as shown in FIG. 18 in position to move cables through channels in a deck segment.
Figure 18:
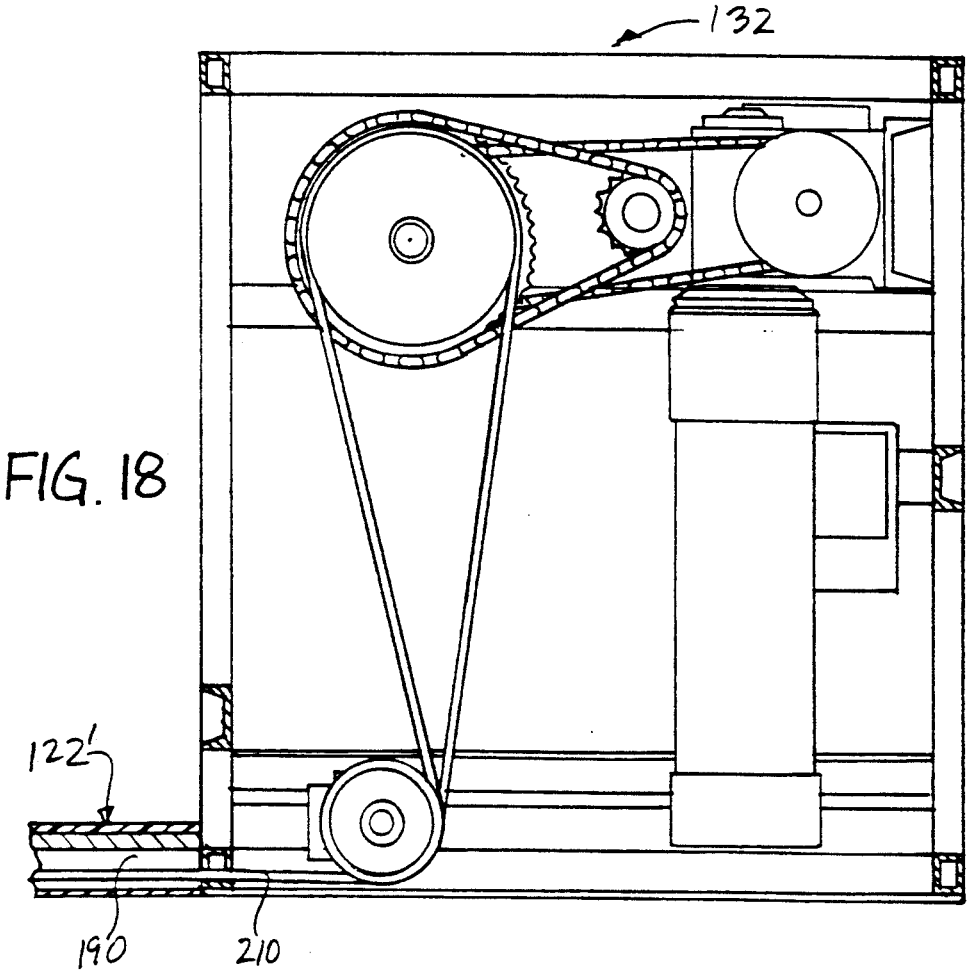
FIG. 18 is a powered capstan for providing motive force to cables used for moving set components.

FIG. 18 illustrates a powered capstan 132 for providing motive force to cables used for moving set components. FIG. 19 is a top plan view of a powered capstan as shown in FIG. 18 in position to move cables (e.g., cable 210 and its return) through track 190 in a deck segment 122'. FIG. 16 also illustrates a second capstan 132*a* which can be employed to provide motive force for the stairs or other set component.

The above description is for the purpose of teaching the person of ordinary skill in the art how to practice the present invention, and it is not intended to detail all of those obvious modifications and variations of it which will become apparent to the skilled worker upon reading the description. It is intended, however, that all such obvious modifications and variations be included within the scope of the present invention which is defined by the following claims. The claims are meant to cover the claimed elements and steps in any arrangement or sequence which is effective to meet the objectives there intended, unless the context specifically indicates the contrary.

We claim:

1. A performance stage deck comprising a plurality of interlocked deck segments which together form a substantially continuous performance surface, wherein at lest some of the deck segments are reusable segments comprising:

a frame including a top, a bottom, a first pair of opposed sides, and a second pair of opposed sides;

an upper deck surface supported by the top of the frame;

guide means on said first pair of opposed sides to vertically and horizontally align those sides with adjacent deck segments having complimentary guide means;

guide means on said second pair of opposed sides to vertically align those sides with adjacent deck segments having complimentary guide means;

lock means to lock aligned sides of adjacent deck segments;

and at least one cable track deck segment comprising a track for supporting cables between the top and bottom of the frame.

2. A deck according to claim 1 wherein said reusable segments further include low-friction pads on the bottom of the frame.

3. A deck according to claim 1 wherein said guide means on said first pair of opposed sides includes an elongated alignment member projecting from one side and a receptacle for a like elongated member on the other side.

4. A deck according to claim 3 wherein said elongated alignment member comprises a removable rod having a tapered end projecting from said one side.

5. A deck according to claim 3 wherein said receptable has an outwardly-flared opening for receiving an elongated alignment member of an adjacent deck segment.

6. A deck according to claim 1 wherein said guide means on said second pair of opposed sides include an elongated tongue element on one side and an elongated groove element on the other.

7. A deck according to claim 6 wherein the tongue and groove elements have low friction surfaces to facilitate sliding movement between engaged complimentary members on adjacent segments.

8. A deck according to claim 1 wherein said upper surface is formed by a flat sheet which overhangs the sides of the frames sufficiently to cover the guide means and provide an essentially continuous surface between adjacent deck segments.

9. A deck according to claim 1 wherein the performance surface includes an elongated opening above the track, the opening being adapted to permit movement of a dog along said opening and thereby enable moving objects connected to said dog across the performance surface.

10. A performance stage deck comprising a plurality of interlocked deck segments which together form a substantially continuous performance surface, wherein at least some of the deck segments are reusable segments comprising:

a frame including a top, a bottom, a first pair of opposed sides, and a second pair of opposed sides;

guide means on said first pair of opposed sides, including an elongated alignment member projecting from one side and a receptacle with an outwardly-flared opening for a like elongated member on the other side, to vertically and horizontally align those sides with sides of adjacent deck segments having complimentary guide means;

guide means on said second pair of opposed sides, including an elongated tongue element on one side and an elongated groove element on the other with low friction surfaces to facilitate sliding movement between engaged complimentary members on adjacent segments, to vertically align those sides with adjacent deck segments having complimentary guide means;

low-friction pads on the bottom of the frame to facilitate sliding the deck segments across a stage surface to engage complimentary guide means on adjacent deck segments;

an upper deck surface comprising a flat sheet which is supported by the top of the frame and overhangs the sides of the frame sufficiently to cover the guide means and provide an essentially continuous surface between adjacent deck segments;

lock means to interlock aligned sides of adjacent deck segments; and at least one deck segment comprising a track for supporting cables between the top and bottom of the frame.

11. A deck according to claim 10 wherein said elongated alignment member comprises a removable rod having a tapered end projecting from said one side.

12. A performance stage deck comprising a plurality of interlocked deck segments which together form a substantially continuous performance surface, wherein at least some of the deck segments are reusable segments comprising:

a frame including a top, a bottom, a first pair of opposed sides, and a second pair of opposed sides;

guide means on said first pair of opposed sides, including an elongated alignment member projecting from one side and a receptacle with an outwardly-flared opening for a like elongated member on the other side, to vertically and horizontally align those sides with sides of adjacent deck segments having complimentary guide means;

guide means on said second pair of opposed sides, including an elongated tongue element on one side and an elongated grove element on the other with low friction surfaces to facilitate sliding movement between engaged complimentary members on adjacent segments, to vertically align those sides with adjacent deck segments having complimentary guide means;

low-friction pads on the bottom of the frame to facilitate sliding the deck segments across a stage surface to engage complimentary guide means on adjacent deck segments;

an upper deck surface comprising a flat sheet which is supported by the top of the frame and overhangs the sides of the frame sufficiently to cover the guide means and provide an essentially continuous surface between adjacent deck segments;

lock means to interlock aligned sides of adjacent deck segments; and wherein the upper surface includes an elongated opening above a track, the opening being adapted to permit movement of a dog along said opening and thereby enable moving objects connected to said dog across the performance surface.

13. A performance stage deck comprising a plurality of interlocked deck segments which together form a substantially continuous performance surface, wherein at least two of the deck segments are basic structural segments and at least one deck segment comprises a track segment for supporting cables between the top and bottom of the frame, the basic structural segments comprising a frame including a top, a bottom, a first pair of opposed sides, and a second pair of opposed sides;

guide means on said first pair of opposed sides, including an elongated alignment member projecting from one side and a receptacle for a like elongated member on the other side, to vertically and horizontally align those sides with sides of adjacent deck segments having complimentary guide means;

guide means on said second pair of opposed sides, including an elongated tongue element on one side and an elongated groove element on the other with low friction surfaces to facilitate sliding movement between engaged complimentary members on adjacent segments, to vertically align those sides with adjacent deck segments having complimentary guide means;

low-friction pads on the bottom of the frame to facilitate sliding the deck segments across a stage surface to engage complimentary guide means on adjacent deck segments;

an upper deck surface comprising a flat sheet which is supported by the top of the frame and overhangs the sides of the frame sufficiently to cover the guide means when engaged with complimentary means and provide an essentially continuous surface between adjacent deck segments; and lock means to interlock aligned sides of adjacent deck segments; and the cable track segment comprising an upper surface including an elongated opening above a track, the opening being adapted to permit movement of a dog along said opening and thereby enable moving objects connected to said dog across the upper surface.

14. A performance stage deck cable track segment comprising:

a frame including a top, a bottom, a first pair of opposed sides, and a second pair of opposed sides;

an upper deck surface supported by the top of the frame;

guide means on said first pair of opposed sides to vertically align those sides with adjacent deck segments having complimentary guide means;

lock means to lock aligned sides of adjacent deck segments;

a track for guiding a dog between the top and bottom of the frame; and an elongated opening above the track, the opening being adapted to permit movement of a dog along said opening and thereby enable moving of objects connected to said dog across the performance surface.

15. A deck segment according to claim 14 wherein said reusable segments further include low-friction supports and guide means.

16. A deck segment according to claim 14 wherein said guide means includes an elongated alignment member projecting from one side and a receptacle for a like elongated member on the other side.

17. A deck segment according to claim 14 wherein said guide means include an elongated tongue element on one side and an elongated groove element on the other.

18. A deck segment according to claim 14 which further includes a protected cable return in said track.

19. A deck segment according to claim 14 wherein the track comprises a guide tunnel through which the dog can move.

20. A method for assembling a performance stage deck comprised of a plurality of interlocked deck segments which together form a substantially continuous performance surface, the method comprising:

(a) providing at least two reusable deck segments which each comprise a frame including a top, a bottom, a first pair of opposed sides, and a second pair of opposed sides;

an upper deck surface supported by the top of the frame;

guide means on said first pair of opposed sides to vertically and horizontally align those sides with adjacent deck segments having complimentary guide means;

guide means on said second pair of opposed sides to vertically align those sides with adjacent deck segments having complimentary guide means;

lock means to lock aligned sides of adjacent deck segments; and at lest one track segment comprising a track for supporting cables between the top and bottom of the frame;

(b) sliding the segments over the surface of a stage to engage complimentary guide means on the two deck segments; and (c) engaging said lock means to interlock the two deck segments.

21. A method according to claim 20 wherein said reusable segments further include low-friction pads on the bottom of the frame.

22. A method according to claim 20 wherein said guide means on said first pair of opposed sides includes an elongated alignment member projecting from one side and a receptacle for a like elongated member on the other side.

23. A method according to claim 16 wherein the upper surface of the track segment includes an elongated opening above a track, the opening being adapted to permit movement of a dog along said opening and thereby enable moving objects connected to said dog across the performance surface.

* * * * *